US005301390A

United States Patent [19]

Cleal

[11] Patent Number: 5,301,390

[45] Date of Patent: Apr. 12, 1994

[54] HINGE MECHANISM FOR PANELS

[75] Inventor: Brian E. Cleal, Hayling Island, Great Britain

[73] Assignee: Lewmar Marine Limited, Hampshire, England

[21] Appl. No.: 857,491

[22] Filed: Mar. 25, 1992

[30] Foreign Application Priority Data

Mar. 25, 1991 [GB] United Kingdom ..... 9106283

[51] Int. Cl.[5] ..... E05F 1/08; E05D 11/10

[52] U.S. Cl. ..... 16/306; 16/285; 16/346; 16/339

[58] Field of Search ..... 16/306, 285, 297, 346, 16/339; 49/383, 379

[56] References Cited

U.S. PATENT DOCUMENTS 1,387,833 8/1921 Cheney .
2,509,462 5/1950 Vogel .
3,111,704 11/1963 Johnson ..... 16/339

FOREIGN PATENT DOCUMENTS 563088 9/1958 Canada ..... 16/306
537185 6/1941 United Kingdom .
2133831 8/1984 United Kingdom .
8300314 2/1983 World Int. Prop. O. .

*Primary Examiner*—John Sipos
*Assistant Examiner*—Carmine Cuda
*Attorney, Agent, or Firm*—Longacre & White

[57] ABSTRACT

A hinge assembly for counter-balancing a panel e.g. a hatch cover of a boat when the latter is rotated about a horizontal axis has levers pivotally attached to the panel, to the deck and to each other, with a torsion spring arranged coaxially on the pivot between the two levers. Also at that pivot axis a friction brake is provided.

2 Claims, 4 Drawing Sheets

HINGE MECHANISM FOR PANELS

FIELD OF THE INVENTION

This invention relates to the hingeing and positioning of panels, such as hatch covers in the deck of watercraft, which pivot about an axis along the side of a frame. More particularly, it relates to hinges which include means for tending to counter-balance the moment of the weight of a hatch cover so as ideally to allow the cover to be left at any angle relative to the horizontal.

BACKGROUND OF THE INVENTION

GB-A-2133831 (Societe Anonyme Goiot SA) discloses panel hinges which have a balancing coil spring coaxial with the axis of rotation. The spring substantially counter-balances the torque of the panel weight and so assists lifting of the panel. The hinges also include washers which form a friction brake between an element rigidly connected to the panel and an element rigidly connected to a deck. The frictional interaction and the braking torque thus provided are adjustable and enable the panel to remain at any angle between horizontal and vertical. The hinge system is situated along one outside edge of the panel and is therefore exposed to the weather and vulnerable to damage.

Tension springs are seen in GB-A-537185, acting between lever arms pivoted to each other and to a wall and to a door respectively. The pivot axis of the door is vertical. Abutments on the levers act on the springs at angles of opening of the door beyond 90° so that it maintains the position to which it is put. At angles below 90° of opening the springs urge the door closed.

SUMMARY OF THE INVENTION

The object of the invention is to provide a hinge mechanism for mounting a panel at an edge portion of an aperture, wherein substantially the whole of the mechanism is mountable at the underside (inner side) of the panel so that it and particularly its spring are protected by the panel when the latter is in its closed condition. Such a mechanism is particularly suitable for hatch covers or ventilation panels for yachts, caravans or lorries, or escape doors, where the panel pivots about an axis which is horizontal or at least has a horizontal component.

According to the invention there is provided a hinge mechanism for rotation of a panel about a pivot axis at an edge portion around an aperture, the axis being for having at least a horizontal component, the mechanism having a hinge with a second arm for securing rigidly to the edge portion, and with a first arm for pivotal attachment to the second arm at the pivot axis, the first arm being for securing rigidly to the panel to be rotatable with the panel about the pivot axis for opening or closing the aperture, and a balancing arrangement including a first lever for pivotal attachment to the panel and a second lever for pivotal attachment to the edge portion, the levers being pivotally joined at a second axis so that the levers form a pivotal linkage responding to relative pivotal movement of the edge portion and panel to conditions of the panel wherein the aperture is respectively closed and open, the balancing arrangement further including a helical spring arranged coaxially at the second axis to act on the levers and having a condition of least potential energy in a position of the linkage intermediate the closed and open conditions of the panel, to tend to counter-balance variably the moment of the panel about the pivot axis due to the weight of the panel and a friction brake acting between the panel and the edge to tend to maintain the panel and the edge in a given relative condition.

Preferably, the spring has minimum potential energy when the panel is vertical, so that torque is provided by the spring to tend to counter-balance the moment of the panel when the panel is at any angle other than vertical.

The second hinge arm may have a bend in it so that when the hinge is secured in position the hinge axis is above that of the pivotal attachment of the first hinge arm and the second lever of the balancing arrangement. This second lever may also have a bend and be pivoted at an inner periphery of a frame at the edge portion of the aperture, the dimensions of the components being preferably chosen to be such that when the panel is in a closed position the balancing arrangement does not project below the frame, and such that, in the case where the hinge is secured to a frame forming a hatchway in a deck, the panel may be opened to a full extent to lie on the deck.

The first lever is preferably made up of two essentially mirror-image arm elements lying axially side by side and entrapping between their hubs a hub of the second lever. In this conformation two helical springs may if desired be entrapped about the second axis one by each of the elements.

The friction-brake preferably includes a spring-loaded braking arrangement with a friction disc coaxial with the second axis and between hubs of the levers to provide a frictional interaction with the levers and a braking torque. This frictional interaction is preferably adjustable and the friction force can be applied with springs axially mounted about the second axis. In any case, the braking torque thus provided should preferably be sufficient in conjunction with the action of the spring to allow the panel to be left at any angle.

The use of friction discs reduces wear of the levers and eliminates any noise due to the stick/slip of the mating faces of their hubs.

The use of friction discs made of brass is preferred for these purposes.

DESCRIPTION OF THE DRAWINGS

An embodiment of the present invention will be described with reference to the following drawings, wherein.

DESCRIPTION OF THE PRESENTLY PREFERRED EMBODIMENT

Figure 1A:
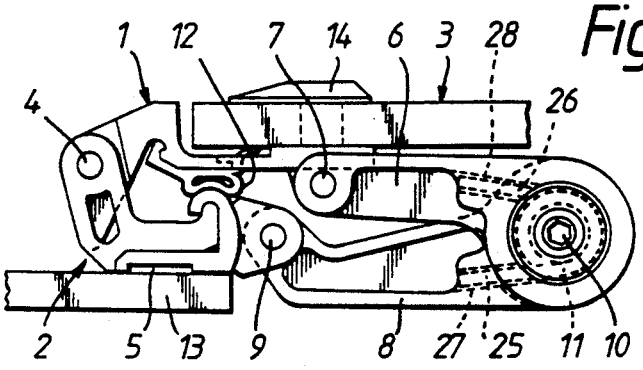
FIGS. 1*a*, 1*b* and 1*c* are side views of a hinge mechanism embodying the invention with the panel in closed, 90° open and 183° open conditions respectively.

In the drawings, FIG. 1*a* shows a first arm 1 of a hinge attached to a panel 3, with the arm 1 pivotally attached at an axis 4 to a second arm 2 of the hinge. The arm 2 may be secured rigidly down onto an edge portion 13 of a deck around an aperture e.g. of a deck hatch via frame 5. The panel 3 is rotatable about the axis 4 which is intended to be disposed substantially horizontally. A first lever 6 is pivotally attached at pivot 7 to the underside of panel 3 and a second lever 8 is pivotally attached with arm 2 via the frame 5 at pivot 9. The levers 6 and 8 are pivotally joined at a second axis 10 formed by a spindle. All the axes and pivots are parallel. Torsion spring 11 is coaxial with spindle 10 and acts between the levers 6 and 8.

The lever 8 is formed in two arm elements 8*a*,8*b* (see FIG. 2), which are essentially mirror images of each other and which have hubs 22,23 which when mounted on axis 10 entrap hub 24 of the lever 6. They also entrap helical torsion springs 11, one spring between hubs 22 and 24 and one between hubs 23 and 24. If the expected moment is low, only one such spring need be provided. End legs 25,26 at respective axial ends of the springs are received in respective recesses 27,28 in the mutually staggered end faces of the levers 6 and 8. Thus the assembly is readily put together: torque to and from the spring is exerted between those legs and respective walls of the recesses. Since the recesses are on inner facing faces the springs are concealed.

Figure 4:
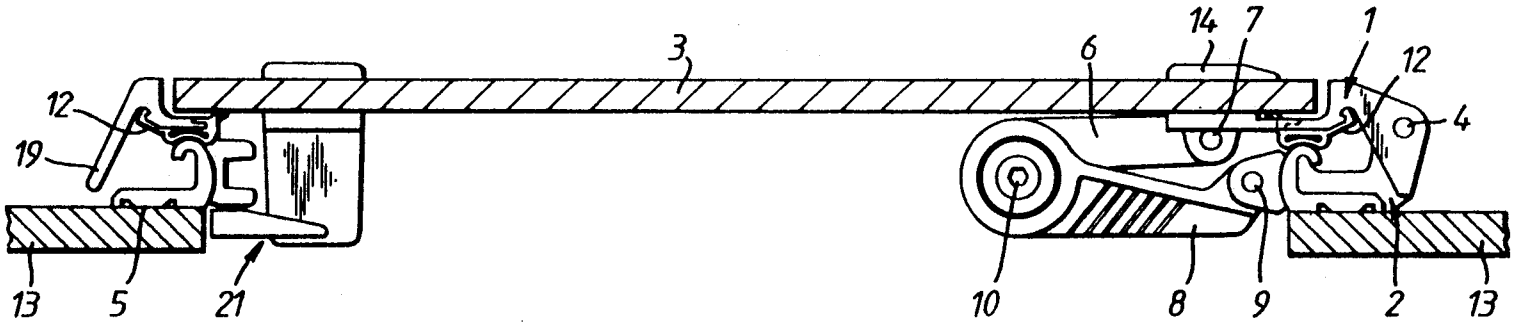
FIG. 4 is a side view of the same hinge mechanism embodying the invention with a panel in a closed position.

In FIG. 1*a* the hinge mechanism is shown with the panel 3 in a closed position with torsion helical spring 11 wound up to provide maximum torque to counter-balance the moment of the panel 3 about hinge axis 4. In this closed position (FIG. 4), the balancing arrangement is protected by the panel 3 and seal 12, attached to hinge arm 1 and around a panel frame 19, contacts bracket 5 to improve this protection. In this condition, the mechanism has depth approximating to that of the deck, below the panel.

Figure 1B:
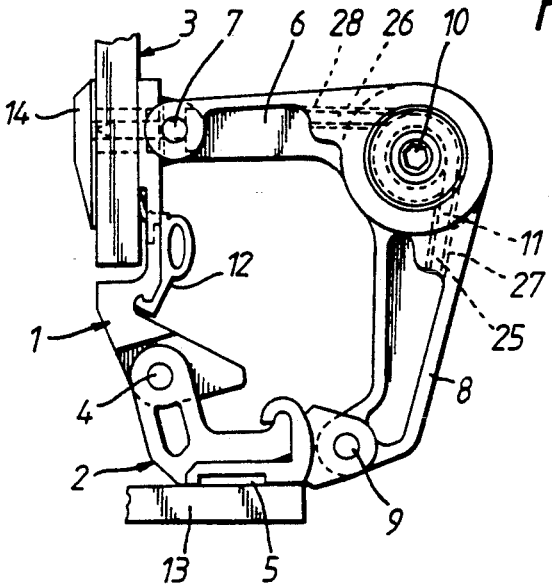

FIG. 1*b* shows the same mechanism with panel 1 at 90° relative to the closed position and the torsion spring 11 relaxed, having no potential energy and providing no torque.

Figure 1C:
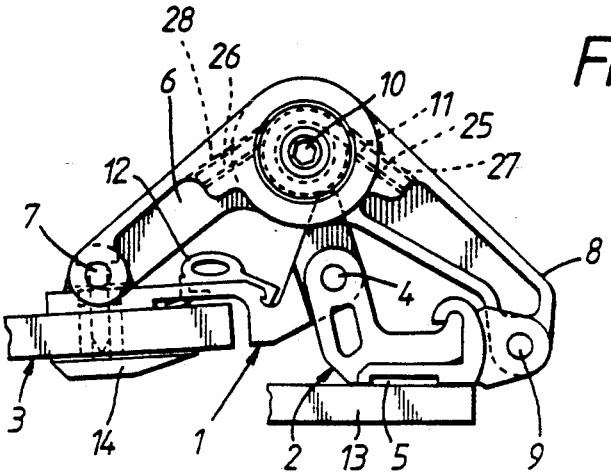

FIG. 1*c* shows the same mechanism with the panel 1 at 183° relative to the closed position with the torsion spring 11 unwound to provide maximum torque to counter-balance the moment of the panel 3 about hinge axis 4 in the direction opposite to that in FIG. 1*a*. The panel then rests on the deck. In this condition the levers are maximally clear of obstruction to the through-passage through the aperture.

Figure 2:
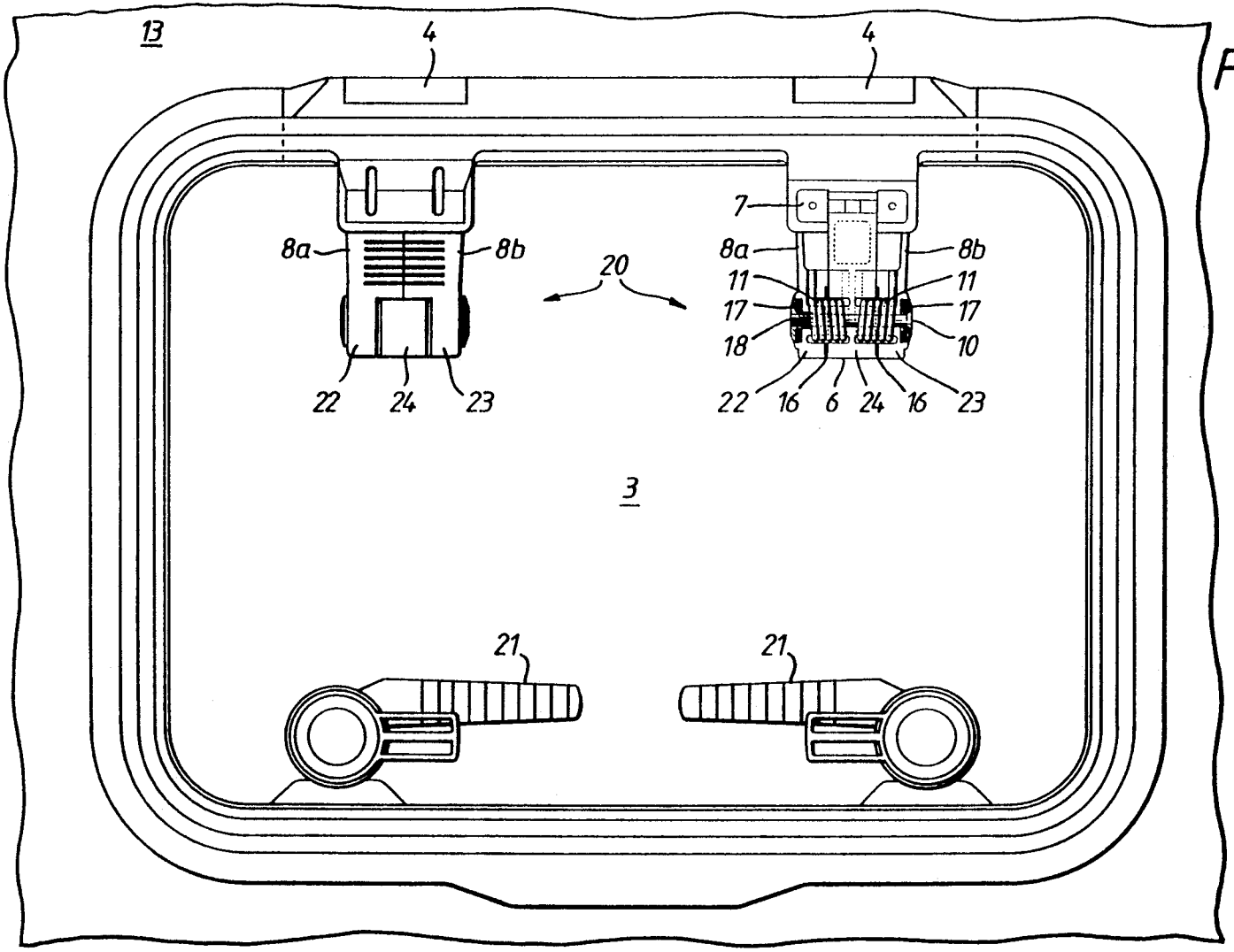
FIG. 2 shows in top view with the panel missing two such hinge mechanism units, one of which is cutaway to illustrate a braking arrangement and positioning of torsion springs within the mechanism.

FIG. 2 shows two hinge mechanism units 20 and two locking handle mechanisms 21 of a conventional nature. The panel is to pivot about the hinge axis 4 of each of the units 20 when they are secured down to a frame 5 surrounding, for example, a hatchway aperture in the deck 13 of a yacht.

Figure 3:
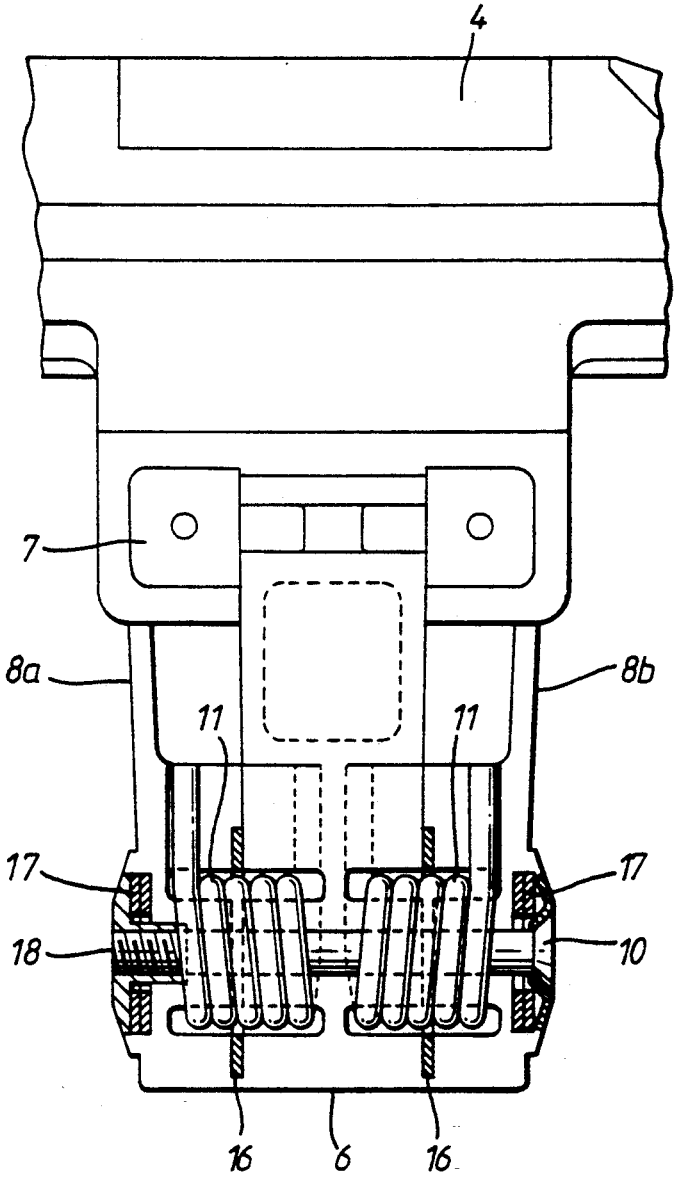
FIG. 3 is an enlarged view of the cutaway hinge unit of FIG. 2.

In FIGS. 2 and 3, a braking arrangement and the positioning of torsion springs are visible in a cutaway view of a hinge mechanism unit. Two torsion springs 11 are coaxial with spindle 10 and engage with levers 6 and 8. In the embodiment shown, there are left and right levers 8 and each has a hub separated from that of lever 6 by friction discs 16 which, together with disc springs 17 provide a friction braking arrangement. The friction discs 16 provide a frictional interaction between hubs of the levers 6 and 8 which is adjustable. The disc springs 17 provide a clamping load to urge the discs and levers together and screw 18, screwed into axis 10, may be turned e.g. by a key inserted in its head to alter the clamping load of the disc springs 17 to adjust the frictional interaction. Initial assembly of the levers together is achieved by the insertion of the screw 18 into the spindle 10.

Although a friction brake may be provided by direct contact of the hubs of the levers the interposition of specific friction discs is preferable from the point of view of control and of avoidance of wear.

FIG. 2 shows two hinge mechanism units and the cutaway section of FIGS. 2 and 3 shows two torsion springs in a unit, but the number of units and the number of springs in each unit can be varied depending on the weight and size of the panel.

When the panel is of certain materials, especially transparent plastics, it may be necessary to distribute the loads associated with its fixation to the hinge arm by e.g. spreader cap 14 opposed to that arm.

I claim:

1. A hinge mechanism for rotation of a panel about a pivot axis at an edge portion around an aperture, the axis having at least a horizontal component, the mechanism having:

a) a hinge with a first arm for securing rigidly to the edge portion, and with a second arm for pivotal attachment to the first arm at the pivot axis, the second arm being for securing rigidly to the panel to be rotatable with the panel about the pivot axis for opening or closing the aperture, and b) a balancing arrangement including a first lever for pivotal attachment to the panel and a second level for pivotal attachment to the edge portion, the levers being pivotally joined at a second axis so that the levers form a pivotal linkage responding to relative pivotal movement of the edge portion and panel to positions of the panel wherein the aperture is respectively closed and open, the balancing arrangement further including helical spring means for variably counter-balancing the moment of the panel about the pivot axis, said helical spring means being arranged coaxially with the second axis to act on the levers such that potential energy in said spring means is at a minimum in a position of the linkage intermediate the closed and open positions of the panel, wherein said second lever comprises two arm elements, each said arm element having a hub portion and said first lever having a hub portion, said hub portions are arranged on said second axis to entrap the hub portion of the first lever between those of the first lever elements, at least one helical spring comprising said spring means being entrapped between a said arm element and said first lever about said axis, and c) a brake for acting between said panel and said edge to tend to maintain said panel and said edge in a given relative condition.

2. A hinge mechanism according to claim 1 wherein a friction disc is positioned between said hub portions for frictional interaction therebetween.

* * * * *